US007361212B2

(12) United States Patent
Clark et al.

(10) Patent No.: US 7,361,212 B2
(45) Date of Patent: Apr. 22, 2008

(54) ELECTROSTATIC PRECIPITATOR

(75) Inventors: James McDonald Clark, Salisbury (GB); Timothy Graham Foat, Salisbury (GB); Maurice Daverell Walker, Salisbury (GB); Stephen Ray Preston, Salisbury (GB)

(73) Assignee: The Secretary of State for Defence (GB)

( * ) Notice: Subject to any disclaimer, the term of this patent is extended or adjusted under 35 U.S.C. 154(b) by 0 days.

(21) Appl. No.: 10/534,453

(22) PCT Filed: Nov. 11, 2003

(86) PCT No.: PCT/GB03/04886

§ 371 (c)(1),
(2), (4) Date: Apr. 14, 2006

(87) PCT Pub. No.: WO2004/043603

PCT Pub. Date: May 27, 2004

(65) Prior Publication Data

US 2006/0249025 A1 Nov. 9, 2006

(30) Foreign Application Priority Data

Nov. 11, 2002 (GB) ..... 0226240.0

(51) Int. Cl.
*B03C 3/40* (2006.01)

(52) U.S. Cl. ..... 96/69; 55/DIG. 38; 96/52; 96/76; 96/95; 96/96; 96/98

(58) Field of Classification Search ..... 96/44, 96/69, 76, 95, 98, 99, 96, 97, 52; 55/DIG. 38
See application file for complete search history.

(56) References Cited

U.S. PATENT DOCUMENTS

| | | | | | |
|---|---|---|---|---|---|
| 1,650,097 | A * | 11/1927 | Schmidt | 96/95 |
| 1,650,105 | A * | 11/1927 | Anderson | 96/95 |
| 2,195,431 | A * | 4/1940 | Shively et al. | 422/186.04 |
| 3,258,897 | A * | 7/1966 | Mayer et al. | 96/76 |
| 3,785,118 | A * | 1/1974 | Robertson | 95/71 |
| 4,354,861 | A * | 10/1982 | Kalt | 96/69 |
| 4,670,026 | A * | 6/1987 | Hoenig | 95/73 |
| 5,055,118 | A * | 10/1991 | Nagoshi et al. | 96/88 |
| 5,214,386 | A | 5/1993 | Singer et al. | 324/452 |
| 5,348,571 | A * | 9/1994 | Weber | 96/68 |
| 5,922,111 | A * | 7/1999 | Omi et al. | 96/60 |
| 6,245,299 | B1 * | 6/2001 | Shiloh et al. | 422/121 |
| 6,294,003 | B1 * | 9/2001 | Ray | 96/49 |
| 6,749,669 | B1 * | 6/2004 | Griffiths et al. | 96/67 |

FOREIGN PATENT DOCUMENTS

| | | |
|---|---|---|
| EP | 0239865 | 10/1987 |
| GB | 1205324 | 9/1970 |

* cited by examiner

*Primary Examiner*—Richard L. Chiesa
(74) *Attorney, Agent, or Firm*—Dean W. Russell; Kilpatrick Stockton LLP

(57) ABSTRACT

An electrostatic precipitator is detailed. The precipitator includes a conduit for the passage of particles in an air flow and a generator of an electrostatic field substantially orthogonal to the air flow, and an ion supply, capable of charging the particles, in which the generator includes a point electrode and a two dimensional surface electrode. The plane surface electrode includes an ion source and the point electrode includes a counter electrode and the counter electrode is earthed.

12 Claims, 4 Drawing Sheets

ELECTROSTATIC PRECIPITATOR

CROSS REFERENCE TO RELATED APPLICATIONS

This application is the U.S. national phase of International Application No. PCT/GB2003/004886 filed on Nov. 11, 2003 and published in English on May 27, 2004 as International Publication No. WO 2004/043603 Al, which application claims priority to Great Britain Application No. 0226240.0 filed on Nov. 11, 2002, the contents of which are incorporated by reference herein.

The present invention is concerned with an electrostatic precipitator. The present invention is particularly, although not exclusively, directed to an electrostatic precipitator suitable for the collection and analysis of an airborne suspension of particles, including micro-organisms, in an environment The analysis of airborne particles in an environment generally requires sampling large volumes of air. Current collection techniques often rely on the acceleration of air to very high velocities in order to utilize the differential momentum between particles and air to impact the particles to a collection surface or liquid. Such impaction techniques, however, generally require a very high energy input and are limited in their ability to separate small particles (below 1 μm).

The collection of particles at an electrode surface in an electrostatic field is a well-known phenomenon underlying the use of electrostatic precipitators to separate dust and smoke particles from an environment. In a simple form of electrostatic precipitator, a high voltage is applied to a wire on a longitudinal axis of an earthed cylinder through which an air flow is maintained. A corona discharge is formed at the wire and ions having the same polarity as the wire are repelled toward the inner surface of the cylinder. The electric field between the wire and the cylinder is, however, distorted by the relative permittivity of the particles compared to the surrounding air and this leads to an aggregation of ions at the particles, which continues until the field distortion is balanced by the charge on the particle. The charged particles experience a force in the electric field carrying them to the earthed cylinder where they adhere. The particles may be dislodged from the surface of the cylinder by vibration or by subsequent passage of a collecting fluid.

Electrostatic precipitators of the prior art are, however, mostly concerned with scrubbing of effluent gases on an industrial scale and so little attention has been paid to their application to the problem of optimum sampling of particles from an airborne environment. Indeed, most electrostatic precipitators are unsuitable for the efficient collection of particles from an environment, even when miniaturised, in that the collecting surface of the cylinder is relatively large and consequently only dilute particle samples can be practically obtained.

One approach to the problem of efficient collection of particles from an environment minimises the amount of collecting fluid used in a miniaturized electrostatic precipitator (InnovaTek, USA). The precipitator comprises a number of collecting plates having micro-machined channels to which the particles, charged by the release of electrons to the air flow, are preferentially deposited. The particles are collected by the passage of the collecting fluid within the channels.

An alternative approach, developed by Applicant, attempts to tightly focus particles charged by corona discharge field to a point surface. In this arrangement, the earthed electrode comprises a ring electrode allowing charged particles to emerge with the air flow. The charged particles enter an additional electric field provided by an electrode configuration, known to the art as an electrostatic lens. In one configuration of electrostatic lens a number of electrode rings, of identical polarity to the particles, are concentrically arranged above an earthed, pin counter electrode so as to provide an electric field constraining the particles to the counter electrode.

The arrangement is, however, unsatisfactory in that, even when particle size is increased by condensation, the extent of charge developed on the particles at desired airflows is non-uniform. Further, the strength of the focussing field acting on the particles at desired operating voltages and air flow rates often either fails to overcome drag effects or alternatively arrests the emergence of the particles from the charging field. Consequently, even where the number of focussing rings has been optimised, the arrangement allows the focussing of only a proportion of particles passing the earthed counter electrode.

European patent application EP 0 239 865 discloses apparatus for electrostatic collection of particles from a gas stream. The apparatus comprises a first cylindrical electrode defining a number of apertures surrounding a second, cylindrical counter electrode. An ion source is provided by a plurality of point electrodes associated with the apertures in the first cylindrical electrode. The counter electrode is maintained at a negative potential whilst the first cylindrical electrode is grounded so that ion efflux from the positive point electrodes is directed to the counter electrode. Ionised particles travel towards the counter electrode but are, on the whole, collected in a collector arranged below the electrodes.

The present invention generally seeks to allow for the efficient collection and analysis of particles in an environment by providing an improved electrostatic precipitator which is capable of efficiently focussing particles to a point surface.

The present invention starts from the realisation that non-uniform charging of particles in an electrostatic field generated by a corona discharge is due to a concentration gradient of ions developed between the point electrode and the counter electrode. Consequently, particles adjacent the counter electrode, are less likely to develop charge than particles adjacent the point electrode. An arrangement providing an electrostatic field in which the ion concentration gradient is removed or reversed may therefore be expected to allow improved focussing of the particles.

Accordingly, the present invention provides an electrostatic precipitator comprising a conduit for the passage of an air flow containing particles and means generating an electrostatic field, substantially orthogonal to the airflow, and a supply of ions, capable of charging the particles, in which the generating means comprise a point electrode and a two dimensional surface electrode characterised in that the two dimensional surface electrode comprises an ion source and the point electrode comprises a counter electrode and in that the counter electrode is earthed.

It will be understood that, in the arrangement of the present invention, ion transport from the ion source is directed to a point electrode and that consequently the concentration gradient of ions between the two dimensional surface electrode and point electrode is reduced compared to most prior art arrangements.

In a preferred embodiment of the present invention, the two dimensional surface electrode comprises an ion source known to the art as a plasma charger. The use of a plasma charger as an ion source avoids field concentration and minimises corona wind, which can lead to turbulence in the gas stream and affect particle deposition.

In a typical charger, the electrode comprises a strip of insulating material sandwiched between two strips of conducting materials, one of which is of substantially lower surface area than the insulating strip. An alternating potential difference applied to the charger generates an emission of ions from the insulating strip at or adjacent the contacting edge of the smaller conducting strip.

Preferably, the length of the contacting edge is maximized so as to provide the greatest possible concentration of ions over the greatest extent of the conduit means. In a particularly preferred arrangement, the contacting edge of the smaller conducting strip is maximised by the adoption of a castellated configuration.

The plasma electrode may also be configured as a single electrode or as a plurality of single polarity electrodes. In some embodiments of the present invention the electrode comprises a plurality of electrodes.

However, in a preferred embodiment, the two dimensional surface electrode comprises a single hollow cylinder formed from the castellated plasma electrode, which may be conveniently arranged within a cylindrical conduit of substantially similar cross sectional area. In this embodiment an electrostatic field can be maintained across a substantial area and length of the conduit means.

It will be understood that the term "point electrode" is not necessarily limited by any need to discharge ions. Rather the term is used to convey the meaning that the counter electrode provides a low surface area in comparison to the two dimensional surface electrode. The point electrode may, for example comprise a wire or a non-tapering rod or cylinder. Preferably, however, the point electrode comprises a pin.

In a preferred embodiment of the present invention the point electrode is co-axially mounted with the conduit. However, other arrangements, in which the longitudinal axis of the electrode is offset from the longitudinal axis of rotation of the conduit are possible.

It will be understood that the charging of particles in the electrostatic field and the force acting on the charged particles will be determined by a number of variables, including the voltage applied to the electrodes and the rate of airflow. These parameters are selected so as to maximise the charge developed on the particles.

Preferably, the particles are charged to their Pauthenier limit. Still more preferably, the airflow is substantially free from turbulence and drag effects acting on particles moving across the electrostatic field are minimised. It will therefore be apparent that proper selection of these parameters can enable forces acting on the charged particles to overcome drag effects and deflect the particles toward the point electrode.

The present invention provides that the particles are mostly deposited on the counter electrode. It will be apparent that the earthed counter electrode provides, through the absence of stored charge, the significant advantage that particles can be easily collected from the surface of electrode by simple collection means.

Although, the particles may be collected by any convenient means, in a preferred embodiment of the present invention, the counter electrode includes means for delivering a liquid to the surface of the electrode. Preferably, the delivery means comprise an interior channel enabling particles to be collected by the progress of the liquid over the exterior surface of the electrode under gravity. The deposited particles are preferably collected at time intervals.

The present invention provides an electrostatic precipitator in which the electrostatic and ion field not only leads to more uniform particle charging but also focuses the charged particles toward the counter electrode.

The feature that the counter electrode is earthed not only facilitates the collection of particles deposited on the point electrode, but also enables monitoring of the two dimensional electrode by a simple micro-ammeter. Further a high voltage power supply of only a single polarity is required.

The present invention provides an improved electrostatic precipitator in which particles may be collected from an electrode of substantially reduced surface area. The uniform charging of substantially all particles enables them to be collected from the counter electrode to a small liquid volume so enabling rapid sampling and analysis of particles in an airborne environment.

Another advantage of the invention is that high inputs of air may be analysed without the need for rapid acceleration and so low operating powers are used. Further the precipitator may be portable.

In some embodiments of the present invention, the precipitator may nevertheless comprise second means for generating an electrostatic field. In these embodiments the second electrostatic field is a focussing field provided downstream from the first field.

In one embodiment, the second generating means comprise a single point electrode which is co-axially mounted with the conduit at a position downstream from the first point electrode. Preferably, the second point electrode is also an earthed electrode.

In another embodiment, the second generating means further comprise an electrode of suitable polarity to deflect the charged particles to the second point electrode. The electrode may be adapted as a plurality of single polarity electrodes. Preferably, however, the second generating means comprise a ring electrode co-axially mounted with the conduit.

In a further embodiment of the present invention, the second generating means comprise a plurality of ring electrodes of single polarity, each co-axially mounted with the conduit. Preferably, two ring electrodes are used. Still more preferably, the ring electrodes are of differing cross sectional area with the smallest ring being arranged furthest from the first point electrode.

Particles deposited on the second point electrode may be collected by any convenient means and in particular by means previously described for the counter electrode.

The present invention will now be described with reference to a number of embodiments and the accompanying drawings in which FIG. 1 is a schematic illustration of the electrostatic field between a point electrode and a plane surface counter electrode;

FIGS. 2*a*) and 2*b*) show a plan view of a precipitator of a prior art precipitator comprising a point electrode and a cylindrical counter electrode. The resultant field lines and equipotentials are shown.

FIGS. 3*a*) and 3*b*) show a plan view of a preferred embodiment of the precipitator of the present invention. The resultant field lines and equipotentials are shown.

Figure 1:
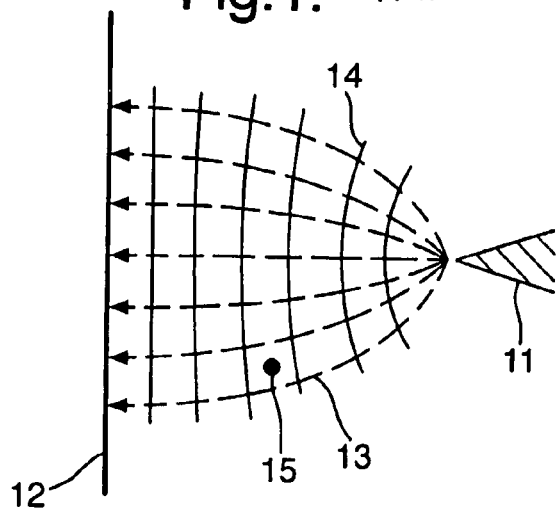
Fig.1. PRIOR ART

Having regard now to FIG. 1, an electrostatic field produced between a point electrode 11 to which a high voltage has been applied and a plane surface electrode 12 has field lines 13 (broken) that outwardly diverge from the point electrode 11. A potential gradient, indicated by the progress of lines of equipotential 14 (full) from the point electrode 11, results in the transport of ions and particles 15 charged in the field along the electric field lines 13 to the plane surface electrode 12.

Figure 2A:
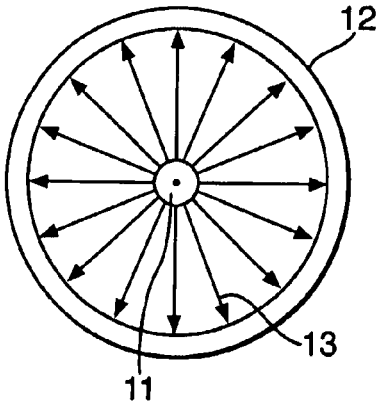
Fig.2a. PRIOR ART
Figure 2B:
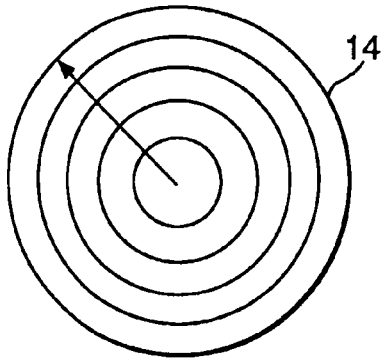
Fig.2b. PRIOR ART

FIGS. 2*a*) and 2*b*) shows the resultant electric field lines 13 and equipotentials 14 when the plane surface electrode 12 is configured as a cylinder electrode and the point electrode 11 co-axially mounted therewith. The arrangement, which forms the basis of a number of prior art precipitators, results in an electrostatic field in which the electric field lines radially diverge from the point electrode 11. The electrostatic field is associated with a potential gradient that results in the transport of ions and particles 15 charged in the field to the ring electrode.

Figure 4:
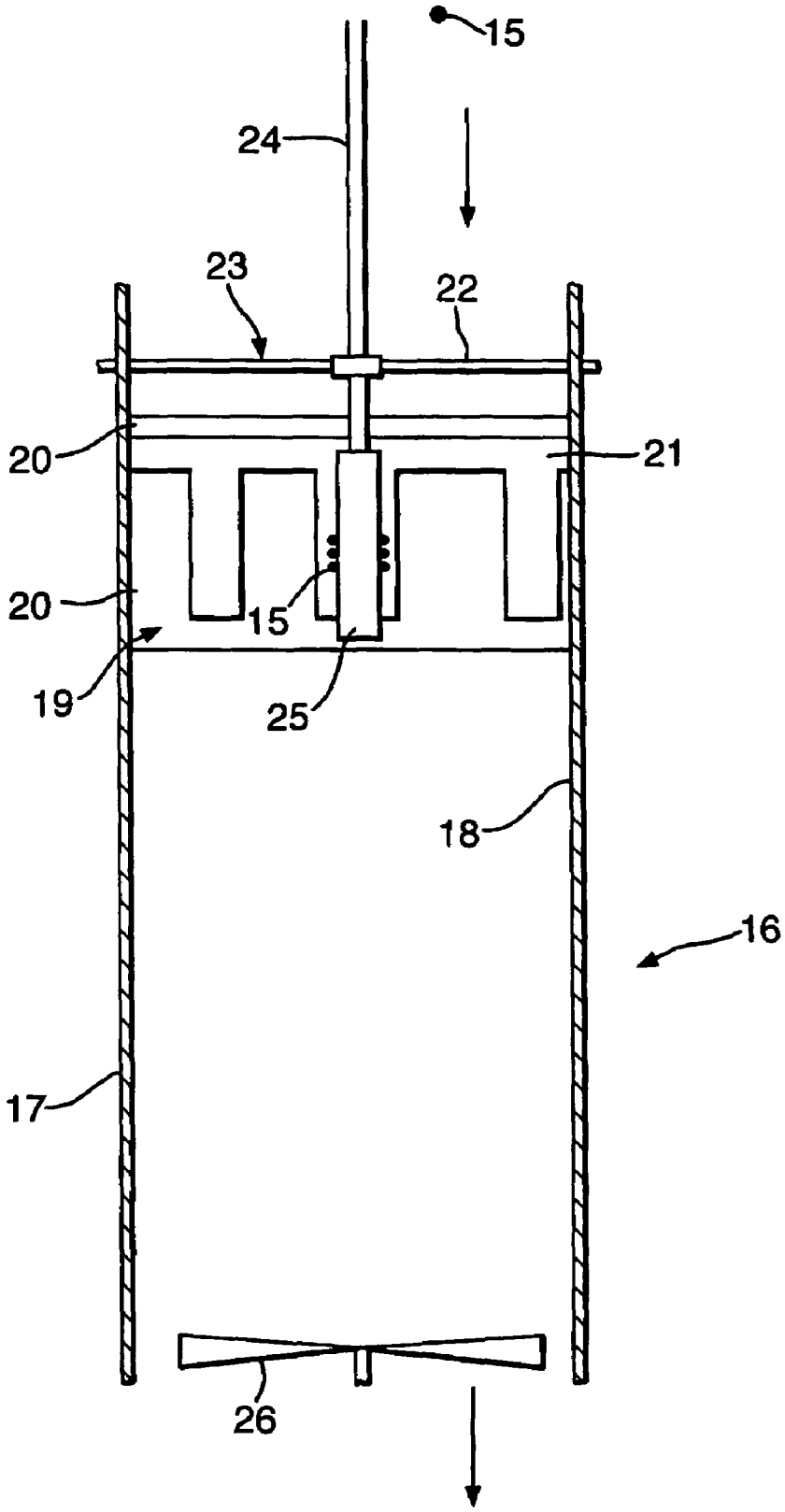
FIG. 4 is a cross sectional elevation view of the embodiment of FIG. 3.

Referring now to FIG. 4, an electrostatic precipitator according to the present invention, generally designated 16, comprises a hollow tube 17 having an inner surface 18 on which a plasma charger electrode 19 is provided. The plasma charger 19 comprises a strip 20 of insulating material sandwiched between two metal plates 21 across which a large alternating potential difference is applied. One plate 21 (shown) is castellated so as to provide a contacting edge with the insulating material 20 that enables the generation ions over a large surface area of the tube 17.

A portion of tube 17 defines apertures for frictional engagement with spokes 22 of a wheel member 23. Wheel member 23 provides a central aperture for frictional engagement with an insulating rod member 24. A portion of the cylindrical rod member 24 is covered with a metal layer 25 and acts as an earthed counter electrode. The rod member 24 is arranged so that the counter electrode 25 is positioned in the tube 17 at a point opposite the plasma electrode 19. A blower 26 is co-axially mounted with tube 17 below rod member 24.

Figure 3A:
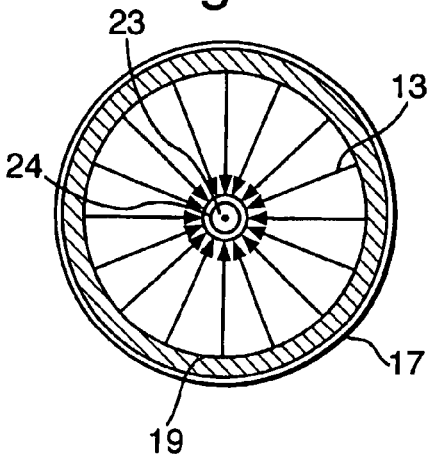
Figure 3B:
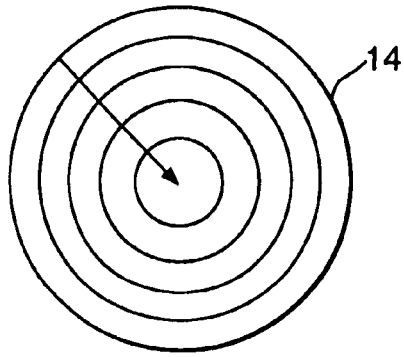

FIGS. 3*a*) and *b*) show the resultant electric field lines 13 and equipotentials 14 the potential difference is applied to the plasma electrode. As may be seen, the electrostatic field is constrained by the size of the counter electrode 25 and is associated with a potential well directed to the counter electrode 25.

In use, air containing uncharged particles 15 is drawn into the tube 17 by the blower 26 where it travels through wheel member 23 into the electrostatic field between the plasma electrode 19 and the counter electrode 25. The airflow and the potential difference applied to the plasma electrode are chosen so that particles 15 entering the field become rapidly charged to their maximum limit enabling the force acting on them to overcome drag effects caused by the airflow. Charged particles 15 are deflected to the counter electrode 25 where they aggregate.

Figure 5:
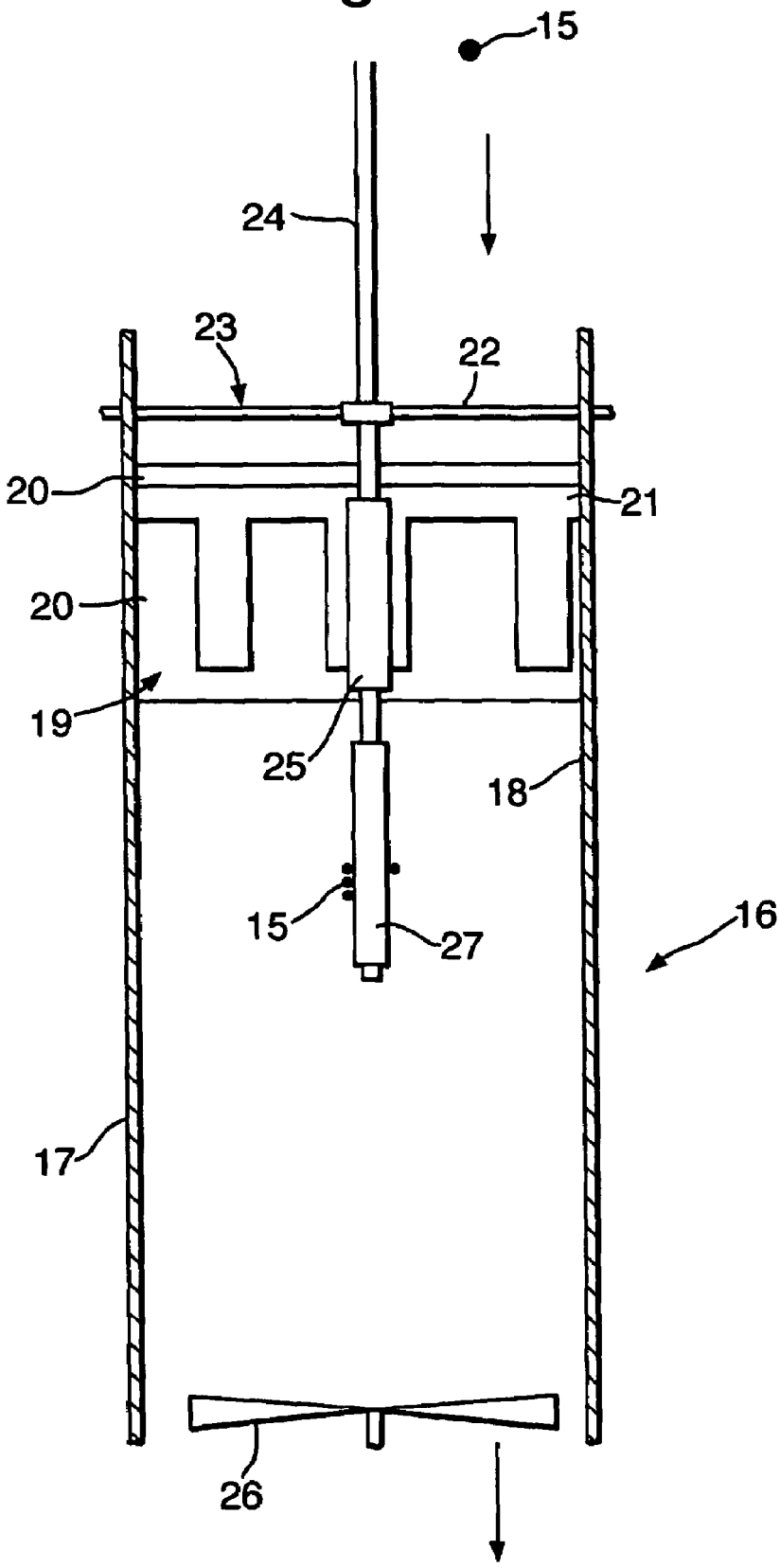
FIG. 5 is a cross sectional elevation view of another embodiment of the present invention.

Referring now to FIG. 5 a second embodiment of the present invention comprises the features of the preferred embodiment except that rod member 24 extends within the tube 17 to a greater extent. A second portion of the cylindrical rod member 24 is covered with a metal layer 27. The metal layer 27 is earthed and acts as a second counter electrode. In this embodiment a second electrostatic field exists between the plasma electrode 19 and the second counter electrode 27. In use, the airflow is increased so that the charged particles 15 are deflected by the second electrostatic field and are deposited at the second counter electrode 27.

It will be understood that the exact positioning of the second counter electrode 27 is of some consequence and is to some extent determined by the strength of each electrostatic field and the rate of airflow.

Figure 6:
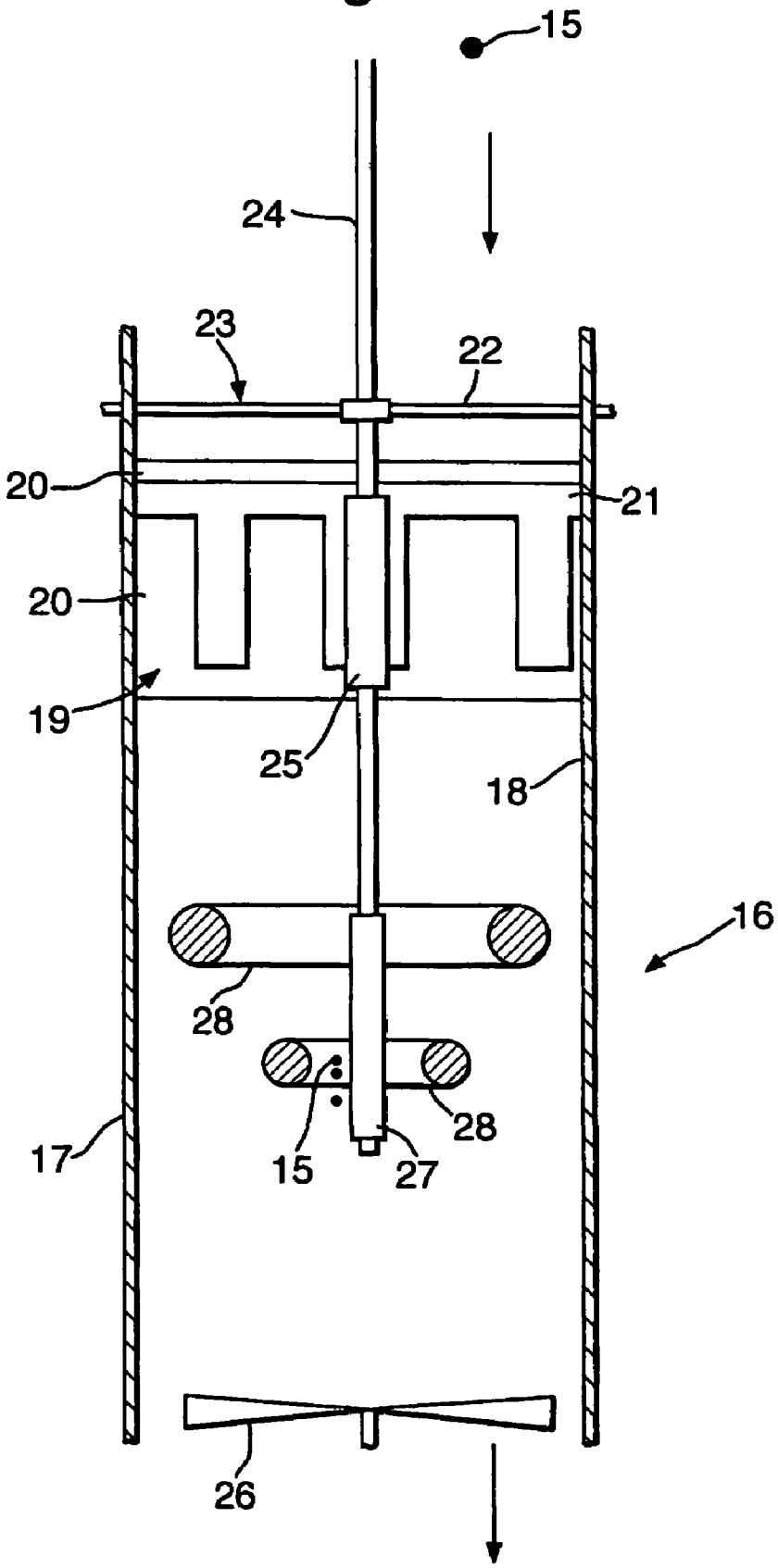
FIG. 6 is a cross sectional elevation view of a further embodiment of the present invention.

Referring now to FIG. 6, a further embodiment of the present invention also comprises the features of the second embodiment. However, the focussing field is now provided by an arrangement comprising the second counter electrode 27 and a number of ring electrodes 28. The arrangement is of a type similar to a known electrostatic lens suitable for focussing electrons in vacuo. However, arrangements in which multiple ring electrodes 28 are provided are no more effective for focussing particles of significant mass than arrangements involving two ring electrodes 28. Consequently this embodiment provides two ring electrodes 28 of differing size which are co-axially mounted with the tube 17 toward the second counter electrode 27. The smaller ring electrode 28 is mounted closest the counter electrode 27 so as to provide a focussing field for charged particles 15 exiting the first electrostatic field. The ring electrodes 28 are charged to the same polarity as the charged particles 15 so that the particles exiting the first electrostatic field and entering the second are deposited on the second counter electrode 27.

The exact positioning of the second counter electrode 27 and the ring electrodes 28, is of some consequence and is to some extent determined by the strength of each electrostatic field and the rate of airflow.

The present invention has been described in relation to a number of simple embodiments and it will be apparent that such variations as may be expected within the art are included within its scope. In particular, the focussing field may be formed by a cylindrical and point electrode arrangement. Further, the precipitator may also comprise a control circuitry for controlling its operation. A microprocessor may also be provided so as to enable calculation of the concentration of particles in an environment by calibration of the number of particles obtained at a particular airflow with currents obtained at the counter electrode.

The invention claimed is:

1. An electrostatic precipitator comprising a conduit for the passage of particles in an air flow and means generating an electrostatic field, substantially orthogonal to the air flow, and an ion supply, capable of charging said particles, in which the generating means comprise a point electrode and a two dimensional surface electrode, wherein the two dimensional surface electrode comprises an ion source and the point electrode comprises a counter electrode and in that the counter electrode is earthed, and further wherein the conduit comprises a hollow cylinder and the two dimensional surface electrode is adapted to cover at least a part of the inner surface thereof.

2. A precipitator according to claim 1, in which the counter electrode is co-axially mounted with the conduit.

3. A precipitator according to claim 1, in which the counter electrode comprises a wire, pin or rod.

4. A precipitator according to claim 1, in which the two dimensional surface electrode comprises a plasma charger.

5. A precipitator according to claim 1, in which the air flow is substantially free from turbulence.

6. A precipitator according to claim 1, comprising second means generating an electrostatic field.

7. An electrostatic precipitator comprising a conduit for the passage of particles in an air flow and means generating an electrostatic field, substantially orthogonal to the air flow, and an ion supply, capable of charging said particles, in which the generating means comprise a point electrode and a two dimensional surface electrode, wherein the two dimensional surface electrode comprises an ion source and the point electrode comprises a counter electrode and in that the counter electrode is earthed, and further wherein the conduit is a hollow parallelepiped and the two dimensional surface electrode is adapted as a plurality of single polarity electrodes on one or more inner surfaces of the conduit.

8. An electrostatic precipitator comprising a conduit for the passage of particles in an air flow, first means generating an electrostatic field, substantially orthogonal to the air flow, second means generating an electrostatic field, and an ion supply, capable of charging said particles, in which the first generating means comprise a point electrode and a two dimensional surface electrode, wherein the two dimensional surface electrode comprises an ion source and the point electrode comprises a counter electrode and in that the counter electrode is earthed, and wherein the second generating means comprise a second point electrode co-axially mounted with the conduit.

9. A precipitator according to claim 8, in which the second generating means further comprises a ring electrode or a plurality of single polarity ring electrodes.

10. A precipitator according to claim 9, in which the second point electrode is an earthed electrode.

11. A precipitator according to claim 8, further comprising means for delivery of a liquid to one or both of the point electrode or the second point electrode.

12. A precipitator according to claim 11, in which one or both of the point electrode or the second point electrode comprise a liquid delivery channel.

* * * * *